United States Patent [19]

Wilson, Jr. et al.

[11] Patent Number: 4,462,227

[45] Date of Patent: Jul. 31, 1984

[54] APPARATUS FOR THE CONTINUOUS TREATMENT OF TEXTILE FIBROUS MATERIALS

[75] Inventors: Julian B. Wilson, Jr.; Anthony W. Nusz, both of Morganton, N.C.

[73] Assignee: Beu-Tex Corporation, Morganton, N.C.

[21] Appl. No.: 390,203

[22] Filed: Jun. 21, 1982

[51] Int. Cl.[3] ..... D06B 21/00; D06B 23/00

[52] U.S. Cl. ..... 68/5 D; 68/9; 68/13 R

[58] Field of Search ..... 68/5 D, 5 E, 9, 13 R; 8/444, 156; 19/65 R, 66 R

[56] References Cited

U.S. PATENT DOCUMENTS 4,104,019 8/1978 Smith ..... 8/444

FOREIGN PATENT DOCUMENTS 232095 8/1944 Switzerland ..... 8/156

2052581 1/1981 United Kingdom ..... 68/13 R

*Primary Examiner*—Philip R. Coe

*Attorney, Agent, or Firm*—Luke J. Wilburn, Jr.; Wellington M. Manning, Jr.

[57] ABSTRACT

Improved apparatus for continuously treating moving textile material in staple length fiber form by impregnating the moving fibers with a dye or other chemical, compressing and conveying the impregnated fibers in a continuous compacted mass form through an elongate heating tube to fix or react the dye chemical on the fibers, and periodically discharging in compacted mass sections of the fibers onto a conveyor which transports the fibers while they are being washed. The improvement in such apparatus comprises a pair of agitating rollers and a pin conveyor section disposed in the path of movement of the compacted fiber mass sections to break the sections apart and generally uniformly distribute the fibers on the washing conveyor to facilitate removal of excess dye or chemical therefrom.

4 Claims, 4 Drawing Figures

APPARATUS FOR THE CONTINUOUS TREATMENT OF TEXTILE FIBROUS MATERIALS

This invention relates to the treatment of textile fibrous materials, and more particularly, to improved apparatus for the application of liquid dye or other chemical to continuously moving textile materials in loose fiber form wherein the fibers are maintained in compacted mass form during chemical or dye fixation thereto. As used herein, the terms "liquid dye or other chemical" means any dye or other chemical which is in a liquid medium form when applied to the textile fibrous materials.

BACKGROUND OF THE INVENTION

U.S. Pat. No. 4,104,019 discloses apparatus and method for fixation of dyes and other chemicals in textile fibers, however formed or combined, wherein the textile fibrous materials are wetted with dye or other chemicals and are continuously mechanically conveyed through a closely confined tube located between electrodes which create a radio frequency (RF) energy field in the tube. The fibrous material is packed within the tube during its passage therethrough so as to provide a partially self-sealing pressure chamber therein due to generation of steam whereby the rate of reaction of the dye or chemical on the fibers is accelerated.

As shown in FIG. 3 of the patent, loose fibrous materials are continuously conveyed by suitable conveyors to a liquid dye or chemical padding unit. The fibers are gravitationally delivered by a conveyor chute into the padding unit which contains a moving belt having an amount, or level, of liquid dye or chemical thereon. The dye or chemical transfers into the fibrous material as it is fed to the nip of a double roller mangle comprising an upper drum and a lower drum over which the belt passes. The pressure of the roller mangle expresses the dye or chemical from the wetted fibers to obtain a desired wet pick-up, after which the fibers are continuously directed into an elongate RF energy heating tube where they are compacted during heat fixation.

It is also known in such equipment as described in U.S. Pat. No. 4,104,019 to utilize a fiber-receiving hopper for receiving the wetted fibrous material from the padding unit and delivering the same under compression into the RF heating tube. The hopper has an open top for gravitationally receiving the wetted fibrous material in a continous stream, or flow, into a lower fiber compression chamber which communicates with the RF energy heating tube. A fluid-actuated ram cycles through the hopper compression chamber to compress and pack the fibrous material into and push it through the heating tube. The compressed fibrous material moving through the tube is heated by RF energy to react or fix the dye or chemical on the fibers, and the material leaves the heating tube against the action of a reduced back pressure piston, after which it is washed, dried and collected in suitable manner.

The apparatus and process above described provides the advantages of a continuous dyeing operation utilizing less energy consumption that the conventional discontinous batch dyeing operations heretofore employed in the prior art. Such apparatus and process also permits effective uniform dyeing of loose fibrous materials with lesser amounts of dye liquid than the prior art batch dyeing operations. Typically, fibrous materials in loose form can be uniformly and effectively dyed utilizing a wet pick-up of dye composition of as low as 100% on the textile fibers.

In the use of the above-described apparatus, the compressed fibrous materials exiting the heating tube against the action of the reduced back pressure piston are discharged intermittently in highly compressed fiber mass sections, or "cakes", and these sections are deposited onto a moving conveyor for subsequent washing, drying, and collection. It is desirable that the loose fibers be thoroughly washed with a suitable washing liquid after heating to ensure that excess chemical or dyes be removed from the fibers before drying and collection. Because of the highly compacted condition of the compressed fiber cakes leaving the confined heating tube, it has been difficult to satisfactorily open the fiber cakes for uniformly washing the individual loose fibers during the continuous treating operation.

It is therefore an object of the present invention to provide improved chemical or dye treating apparatus of the type described wherein means are provided for effectively breaking apart and opening dyed or chemically treated compressed fiber mass sections, or cakes, to uniformly wash the fibers before collection.

It is another object of the invention to provide for the more uniform chemical or dye treatment of textile fibers in a continuous treating operation wherein compressed fibrous mass sections, or cakes, are effectively uniformly broken apart and spread for uniform washing of the fibers during their continuous movement through the apparatus.

SUMMARY OF THE INVENTION

The present invention relates to improved apparatus for the continuous treatment of loose textile fibrous material, specifically wherein the material is impregnated with dye or other chemical, the dye or chemical is reacted or fixed on the fibers by heat while the fibers are maintained in highly compacted compressed mass form, and wherein fiber agitator means are employed to contact moving compressed mass sections of the fibers to break up and generally uniformly disperse the loose fibers therefrom for washing the same before drying and collection. More particularly, the improved apparatus includes an arrangement of moving agitator rollers and conveyors together with pressurized water sources which effectively opens and disperses the fibers from the compacted mass sections by directing portions of the sections in reversing paths of movement under agitation while being continuously conveyed to and through the washing section of the apparatus.

BRIEF DESCRIPTION OF THE DRAWINGS

The above as well as other objects of the invention will become more apparent and the invention will be better understood from the following detailed description of preferred embodiments thereof, when taken together with the accompanying drawings, in which.

DETAILED DESCRIPTION OF PREFERRED EMBODIMENTS

Figure 1:
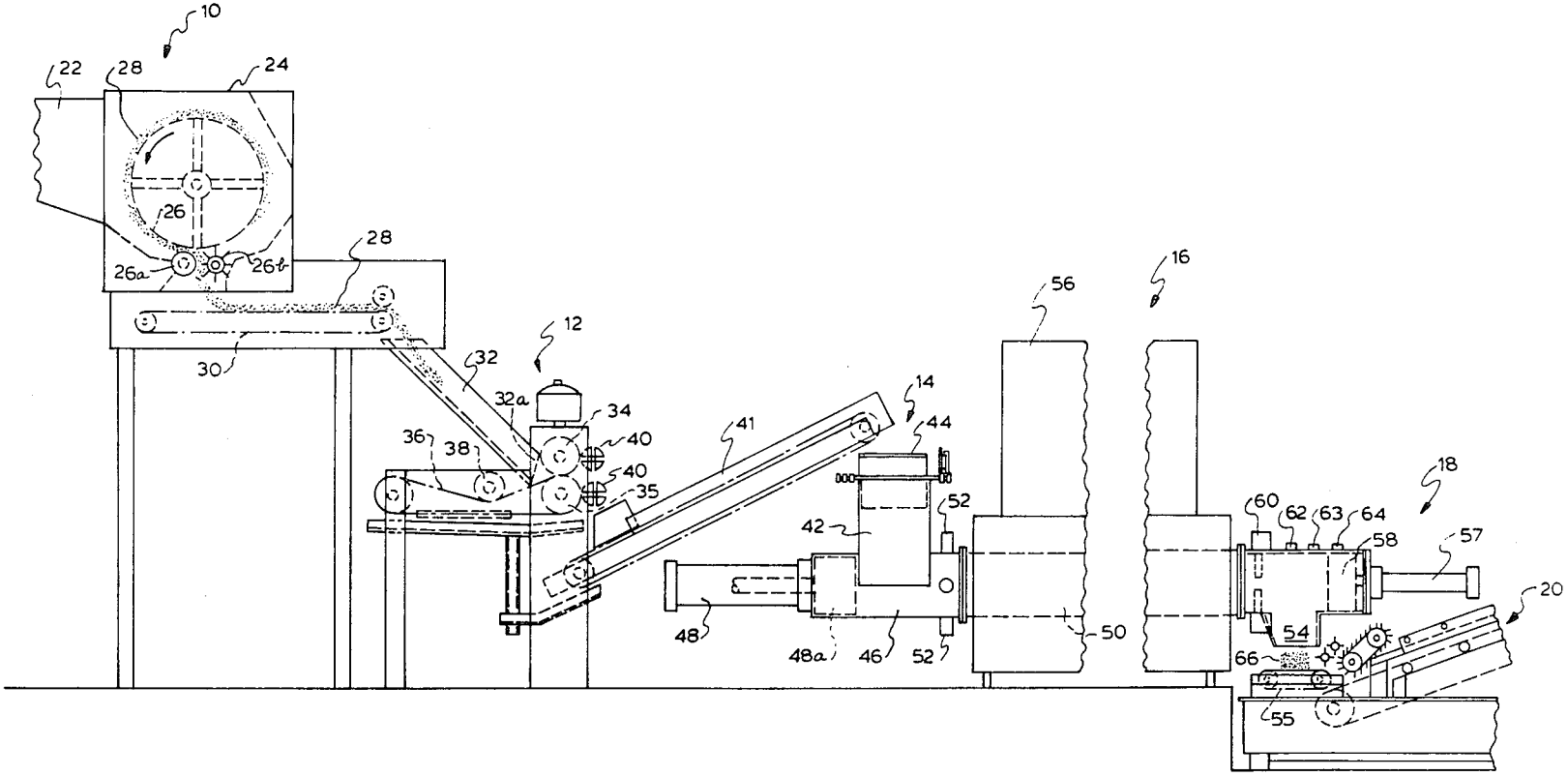
FIG. 1 is an overall schematic side elevation view of apparatus for the continuous treatment of loose fibrous materials embodying improvements and features of the present invention.

Referring more specifically to the drawings, FIG. 1 shows improved apparatus of the present invention for continuously dyeing or otherwise chemically treating textile fibrous material. Basically, the continuous treatment range includes a fibrous material supply section 10, a dye or chemical applicator section 12, a fibrous material compression section 14, a high frequency energy heating tube section 16, a compressed fiber cake breaker section 18, and a washing section 20.

Textile fibrous material, typically in the form of loose staple length fibers, is pneumatically conveyed by way of a delivery tube 22 from a suitable supply source, such as conventional textile opening and weigh pan blending equipment (not shown), into a fiber condenser unit 24 containing a rotating filter drum 26. The interior of the drum is connected to a vacuum source, such as a motorized fan (not shown), such that a condensed fibrous web 28 accumulates on the filter drum outer surface. The drum continuously rotates in the direction indicated to discharge a cohesive web of fibers by way of a pressure roller 26*a* and bladed stripping roller 26*b* onto a moving belt conveyor 30 which continuously delivers the web to an inclined chute conveyor 32. Details of the fiber condenser unit and its use in combination with the other components of the continuous treatment range form the subject matter of a different invention contained in a commonly assigned copending U.S. patent application Ser. No. 390,202, filed June 21, 1982, executed on even date herewith.

The lower outlet end 32*a* of chute 32 is disposed immediately adjacent the nip portion of a pair of mangle rollers 34, 35 of a padding unit of the dye or chemical applicator section 12. The amount of fiber supplied to the treating range is controlled by varying the rate of delivery of fiber to condenser unit 24 of the range, and suitable motor means, e.g., DC drive motors, (not shown) are operatively connected in conventional manner to positively drive the various conveyors and rollers for delivery of fibers through the treating range. The padding unit of dye applicator section 12 comprises an endless driven belt 36, the central portion of the upper reach of which is downwardly deflected by suitable rollers 38 to form a depression, or well, for retaining a treating liquid, such as a liquid dye composition, to be applied to the fiber web. Belt 36 is entrained about the lower mangle roller 35 and moves to convey and transfer the liquid dye composition into the fiber web as it is delivered from the end of the chute 32 into the nip of the mangle rollers. The amount of liquid dye pick up on the fibers is controlled, in conventional manner, by adjustment of nip pressure of the mangle rollers 34, 35. The dye-impregnated fibers are removed from the mangle rollers by bladed scraper rollers 40 and are deposited in broken-apart, smaller masses of fiber onto a continuously moving conveyor 41 which gravitationally delivers the fibers continuously into the upper end of a fiber-receiving hopper 42 of fiber compression section 16.

The upper portion of hopper 42 is provided with a pair of fiber collection plates 44 which are pivotally mounted in overlapping relation for collecting and periodically depositing accumulated fibers into a lower compression chamber 46 of hopper 42. Associated with hopper compression chamber 46 is a fluid-actuated, double-acting hydraulic piston ram assembly 48 which moves through the compression chamber in a generally horizontal direction to compress the fibrous material received therein and push the same into the inlet of an elongate, confined radio-frequency energy heating tube 50. A plurality of hydraulic piston-actuated, fiber-retaining pins 52 are arcuately disposed about the inlet of heating tube 50 and are arranged and operated to move radially into the fiber passageway to retain compressed fibers in the heating tube 50 against backward movement into the compression chamber 46 when the ram compression head 48*a* is retracted for the beginning of each compression stroke.

Details of the operation of the fiber-collecting plates in the upper end of the hopper, and their movement to deposit fibers collected thereon into the compression chamber in response to the absence of the ram compression head therein form the subject matter of a different invention contained in a commonly assigned copending Beucus U.S. patent application Ser. No. 390,207, filed June 21, 1982, executed on even date herewith. The disclosure of said application is incorporated herein by reference.

The compressed mass of fibers passing continuously through tube 50 are heated by conventional RF energy generating equipment which includes an H.T. transformer, rectifier, tube oscillator, and tank circuit adjustable to give a radio frequency of 27.12 megahertz. Such generating equipment, details of which are well known in the art and not shown in the drawings, are enclosed in an insulated protective housing 56. The RF energy imparted to the dye-impregnated, compacted fibers in tube 50 raises the temperature in the fibrous material to a desired degree to set and/or otherwise fix the dye on the fibers, as by ionic bonding of the dye molecules to the fiber molecules.

Figure 2:
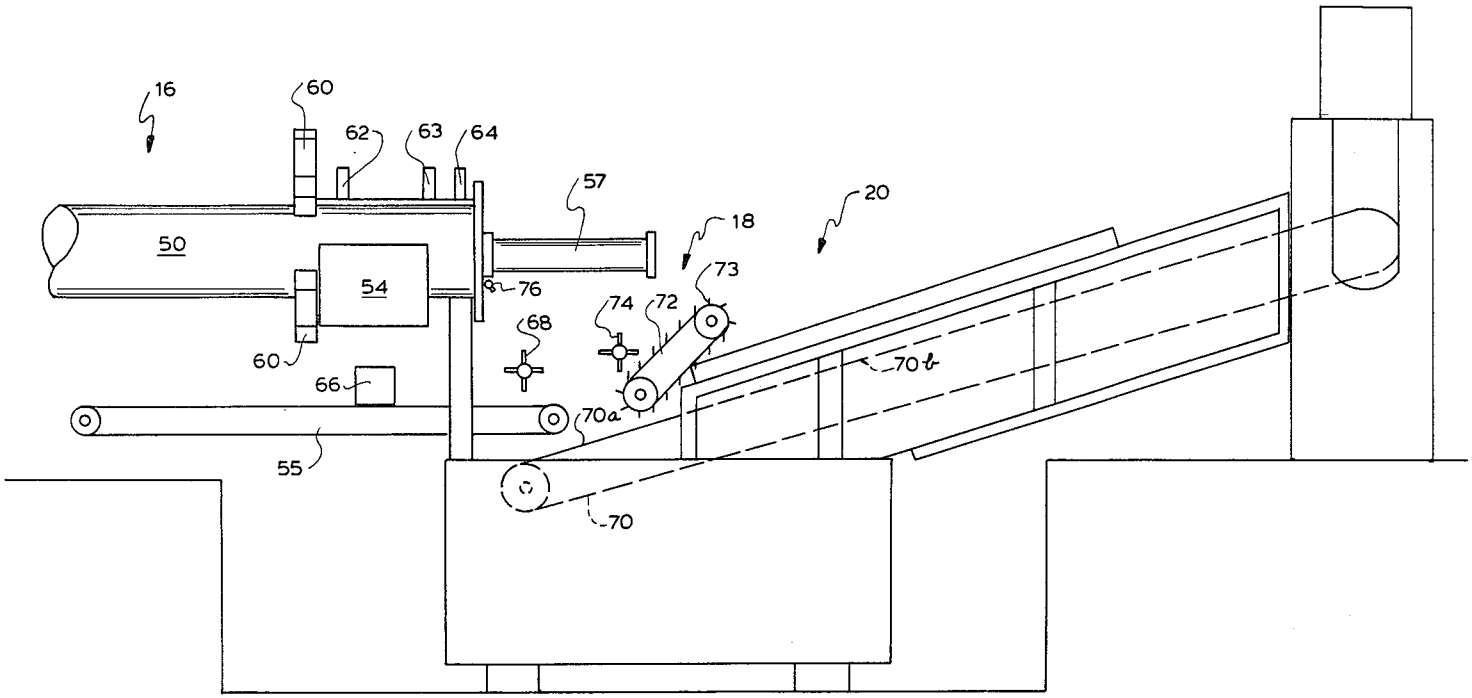
FIG. 2 is an enlarged side elevation view of a portion of the apparatus of FIG. 1 showing in more detail the discharge of compressed fiber mass sections, or cakes, from a confined heating tube and the agitating means for breaking apart and dispersing the fibers from the compressed fiber cakes for washing.
Figure 3:
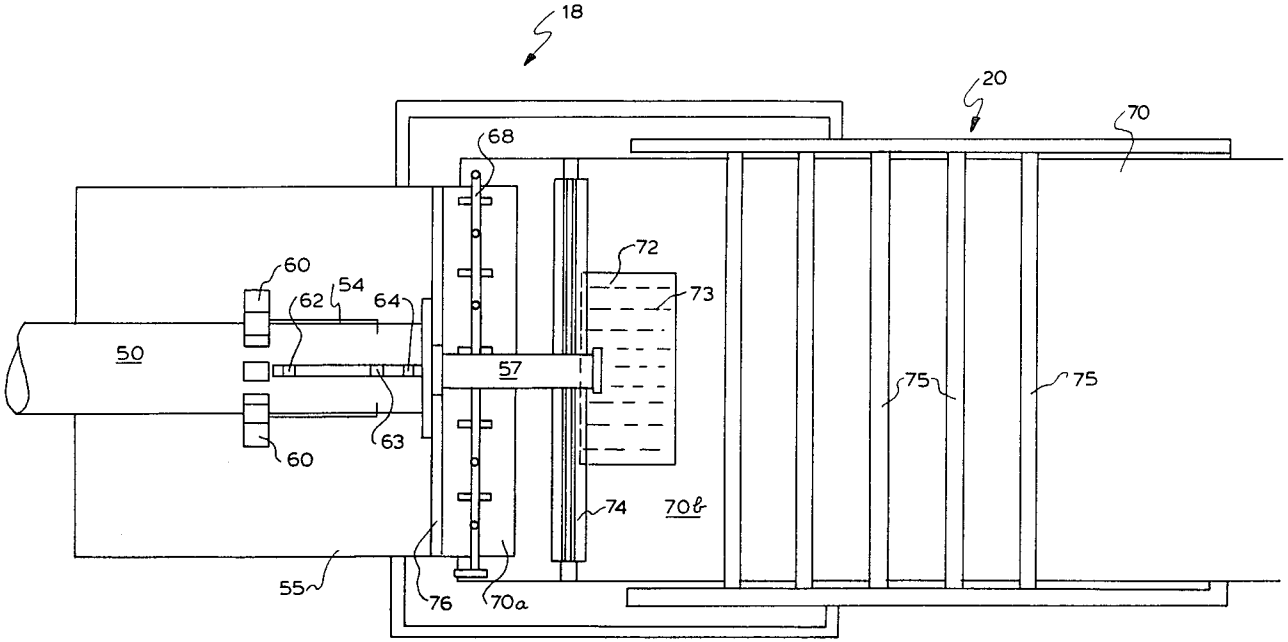
FIG. 3 is a plan view of the portion of the apparatus shown in FIG. 2.
Figure 4:
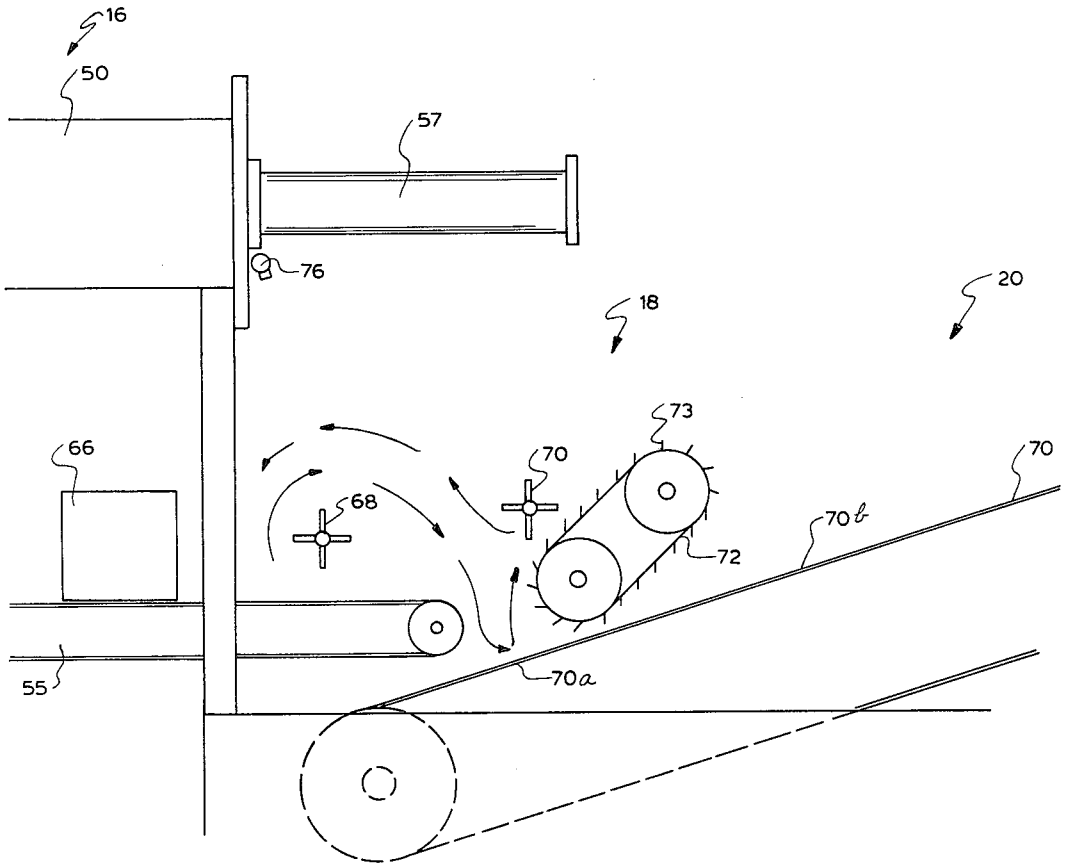
FIG. 4 is a further enlarged schematic side elevation view of the portion of apparatus shown in FIG. 2, illustrating by arrows the general paths and directions of movement of the fiber materials as they are separated during their conveyance for washing before collection.

As best seen in FIGS. 2–4, the exit end of heating tube 50 has a downwardly disposed fiber outlet 54 for discharging fibers onto a moving conveyor 55. Disposed in the exit end portion of heating tube 50 to control periodic discharge of compressed fiber mass sections from the tube outlet 54 is a pneumatic piston 57 with pressure head 58 and a plurality of pneumatic piston-actuated, fiber-retaining pins 60. Pistons of the pressure head 58 and retaining pins 60 are of the double-acting type and connected through conventional air control valves, pressure regulator, and supply lines to a source of pressurized air (not shown). The exit piston pressure head 58 is arranged to move horizontally through the end portion of the heating tube 50 over outlet 54, and located in its path of travel are three switches 62, 63, 64 which are connected to actuate the air control valves and supply pressurized air to the exit piston and pin pistons in the following sequence.

Compressed fiber mass sections 66 are periodically discharged from the heating tube in the following cycle. When the exit piston pressure heat 58 is fully extended into the exit end of the heating tube to close the tube passageway and contact switch 62, pressure regulated air is supplied to the exit piston 57 to maintain a constant counter pressure of the pressure head against compressed fibers in the tube. Pressurized air is also supplied to the pin pistons to fully retract the pins 60 from the heating tube passageway. As fiber pressure builds in the heating tube due to the compressing action of the main compression ram 48, the exit piston pressure head 58 is pushed outwardly of the tube by the moving fiber mass, to the right as seen in FIGS. 2–4, until it contacts switch 63. Switch 63 actuates the air control valves to supply pressurized air to the pin pistons to insert the pins 60 into the heating tube passageway and thereby retain the fibers under compression in the tube upstream of the pin positions. Pressurized air is also supplied to the exit piston 57, after momentary time delay, to move the pressure head 58 quickly further outwardly of the exit end of the heating tube, thereby releasing the section of compacted fibers between the pins and pressure head to fall by gravity through the heating tube outlet 54 and onto the conveyor 55. When pressure head 58 contacts switch 64, pressurized air is supplied to the exit piston 57 to return the pressure head back to its innermost position (FIG. 2) to contact switch 62 and close the tube outlet 54. Contact of the pressure head with switch 62 directs compressed air to again retract the fiber-retaining pins 60 from the heating tube passageway and establish a constant counter pressure of pressure head 58 on the fibers for the beginning of another discharge cycle.

Details of the cake breaker section 18 of the treatment range which embodies improved features of the present invention are best described by reference to FIGS. 2–4. To ensure that excess dye or other chemicals which have not been fixed or otherwise reacted with the fibers in the heating tube 50 are removed from the fibers, the fibers exiting from heating tube 50 are subjected to a washing liquid as they are conveyed prior to drying and collection. To facilitate removal of the excess dyes or chemicals from the fibers, it can be appreciated that it is desirable that the compacted fiber cakes 66 exiting from the heating tube 50 be broken apart and opened to disperse and expose the fibers for better contact with the washing liquid.

For this purpose, the fiber cakes 66, which typically may be a fiber mass section approximately 8 to 10 inches long and 12 inches in diameter, are transported on the surface of horizontal conveyor 55 into contact with first agitating means, shown as a spiked roller or bar 68, which is positioned just above the conveyor surface and is rotatably driven by suitable means (not shown) in a clockwise direction, opposite the direction of movement of the conveyor 55. The moving spikes of roller 68 thus strike each fiber cake 66 passing on the conveyor to break apart fiber portions of the same and direct the fiber portions in a generally arcuate clockwise path over the spiked roller 68 and onto a section 70*a* of the surface of an inclined main conveyor 70 of the washing section 20 of the treatment range.

Positioned adjacent the surface of the washing section conveyor 70 and disposed at an inclined angle thereto is a short upwardly extending driven conveyor 72 having surface pins 73 disposed to collect fibers from the surface of conveyor 70 and move the same in an upward direction. Positioned in close proximity to the upwardly moving surface of the pin conveyor 72 is second agitating means, shown as a bladed roller 74, which is rotatably driven by suitable means (not shown) in a clockwise direction to remove the larger mass portions of compacted fibers carried on the surface pins of conveyor 72 and propel the same in a generally arcuate rearward direction back over onto the horizontal conveyor 55 to be engaged again by spiked roller 68. The separated and more randomly distributed fibers on the pin conveyor 72 pass under the bladed roller 74 and fall from the upper end of pin conveyor 72 to be generally uniformly distributed across the central surface portion 70*b* of washing section conveyor 70. Plural wash water distributing manifolds 75 are disposed across conveyor 70 in spaced relation along and above its path of movement to supply wash liquid to the loose fibers dispersed on conveyor 70.

To further assist in breaking up the fiber cakes as they pass into engagement with the spiked roller, a plurality of streams of high pressure water, or other wash liquid, are directed against the surface of the spiked roller 68 from an overhead liquid discharge manifold 76 which extends across the conveyor 55.

FIG. 4 illustrates by the direction of the arrows therein the cooperative action of the spiked roller 68, pin conveyor 72, bladed roller 74, and pressurized liquid discharge manifold 76 in the fiber cake-breaking system. These fiber cake agitating components serve to effectively separate the cakes into smaller and smaller fiber portions and to direct these portions of the fiber cake in a reversing path through the cake breaker section 18 until the fibers are dispersed in a generally separated, uniform manner across the central surface portion of the wash conveyor 70, thus more effectively exposing individual fibers for washing. Notice that the movement of the fibers, as illustrated by the arrows, is a reversing path to produce a somewhat "rolling" action on the fiber cakes to distribute the individual fibers across the conveyor for contact by the wash liquid from manifold 75 disposed along conveyor 70.

In opening and breaking up fiber cakes of thermoplastic fibers, such as acrylic polyester and polyamide fibers, it is desirable that the streams of high pressure water or wash liquid directed against the surface of the spiked roller 68 from discharge manifold 76 be at a temperature of no less than about 140°–150° F. to avoid possible thermal shock producing temporary heat setting of the fibers in the configuration found in the compressed cake. The relative speed differentials of the spiked roller 68, bladed roller 74 and pin conveyor 72 may be regulated to ensure reversal of the flow of the fiber mass as shown in FIG. 4 to give improved openness of the fibers. The speed pattern may vary according to fiber staple length, type, and weight.

The exact size and positions of the spiked roller and bladed roller may be varied to provide the reversing, rolling action on the fibers of the fiber cakes during their passage through the cake-breaking section. Excellent results have been obtained in dispersing and distributing the fibers of fiber cakes of approximately 12 inch diameter and 8 to 10 inches length by use of a spiked roller having spikes approximately 2 inches long positioned so that the spike tips during rotation describe a circle $3\frac{1}{2}$ inches above the surface of conveyor 55, and with the tips of the blades of the bladed roller describing a circle located $\frac{1}{2}$ from the tips of the pins 73 of the pin conveyor 72.

That which is claimed is:

1. In apparatus for continously treating moving textile materials in fiber form, including means for impregnating the fibers with a dye or other chemical, means for compressing and conveying the impregnated fibers in continous compacted mass form through an elongate heating tube to fix or react the dye or chemical on the fibers, means for periodically discharging compacted mass sections of the fibers from the heating tube, and means for conveying the discharged fiber sections in a path of travel to wash the fibers prior to collection; the improvement therewith comprising means positioned in the path of movement of said compacted fiber mass sections from the heating tube for breaking apart the sections and generally uniformly distributing the fibers on said conveying means to facilitate washing of the fibers prior to collection, said breaking and distributing means comprising first agitating means positioned adjacent a first surface portion of said conveying means for engaging the compacted fiber mass sections and directing fibrous portions of the same in an arcuate path of movement onto a second surface portion of said conveying means, second agitating means positioned adjacent said second surface portion of said conveying means for engaging the fibrous portions of the fiber sections on the conveying means and for redirecting at least portions of the same in an arcuate path back onto said first surface portion of said conveying means for reengagement by said first agitating means.

2. Apparatus as defined in claim 1 wherein said first agitating means comprises a spiked roller positioned above said first surface portion of said conveying means and rotatably driven in a direction opposite the direction of movement of said first surface portion to engage the compressed fiber sections and direct said fibrous portions thereof in an arcuate path generally forwardly in the direction of movement of said first surface portion and onto said second surface portion of the conveying means, said conveying means includes a pin conveyor for picking up the fibrous material from said second surface portion and transporting the same in a generally upwardly inclined angle therefrom, and wherein said second agitating means comprises a bladed roller positioned adjacent the surface of the pin conveyor and rotatable in a direction opposite the direction of movement of the pin conveyor to remove a portion of the fibers therefrom and redirect the same back onto said first surface portion of said conveyor means, whereby the fiber portion is again subjected to the agitating action of said first spike roller.

3. Apparatus as defined in claim 2 wherein said first agitating means further comprises means positioned adjacent said spiked roller for directing pressurized streams of wash liquid thereagainst to facilitate breaking apart the fiber sections contacted by the spiked roller.

4. Apparatus as defined in claim 2 wherein said pin conveyor includes an upper end portion disposed above a third surface portion of said conveying means for delivering fibers thereto in a generally uniform manner across said conveyor surface for subsequent contact by a washing liquid.

* * * * *

UNITED STATES PATENT AND TRADEMARK OFFICE

CERTIFICATE OF CORRECTION

PATENT NO. : 4,462,227

DATED : July 31, 1984

INVENTOR(S) : Julian B. Wilson, Jr. and Anthony W. Nusz

It is certified that error appears in the above-identified patent and that said Letters Patent are hereby corrected as shown below:

In column 4, line 63, "heat" should be--head--.

In column 6, line 58, after "1/2", insert--inch--.

Signed and Sealed this

*Eighth* Day of *January 1985*

[SEAL]

*Attest:*

*Attesting Officer*

GERALD J. MOSSINGHOFF

*Commissioner of Patents and Trademarks*